US008015962B2

(12) United States Patent
Lysinger

(10) Patent No.: US 8,015,962 B2
(45) Date of Patent: Sep. 13, 2011

(54) AIRCRAFT ENGINE CRANKSHAFT POSITION AND ANGULAR VELOCITY DETECTION APPARATUS

(75) Inventor: Forrest Ross Lysinger, Harrisburg, PA (US)

(73) Assignee: Lycoming Engines, a division of Avco Corporation, Williamsport, PA (US)

( * ) Notice: Subject to any disclaimer, the term of this patent is extended or adjusted under 35 U.S.C. 154(b) by 711 days.

(21) Appl. No.: 11/948,424

(22) Filed: Nov. 30, 2007

(65) Prior Publication Data

US 2010/0043750 A1 Feb. 25, 2010

(51) Int. Cl.
*F02P 7/067* (2006.01)

(52) U.S. Cl. ..... 123/406.58; 123/406.61; 123/406.62

(58) Field of Classification Search ..... 123/406.58, 123/406.61, 406.62
See application file for complete search history.

(56) References Cited

U.S. PATENT DOCUMENTS

| | | | | |
|---|---|---|---|---|
| 3,324,841 | A | 6/1967 | Kebbon et al. | |
| 5,117,681 | A | 6/1992 | Dosdall et al. | |
| 5,513,617 | A | 5/1996 | Bass | |
| 6,357,427 | B1 * | 3/2002 | Luttrelll et al. | 123/609 |
| 6,405,708 | B1 * | 6/2002 | Watson | 123/406.6 |
| 6,474,278 | B1 * | 11/2002 | Davis et al. | 123/90.15 |
| 6,679,223 | B2 | 1/2004 | Sakakibara | |
| 6,752,009 | B2 | 6/2004 | Minich et al. | |
| 2003/0060962 | A1 | 3/2003 | Carroll | |
| 2003/0089822 | A1 | 5/2003 | Koch et al. | |
| 2006/0130811 | A1 * | 6/2006 | Carlson et al. | 123/406.53 |

FOREIGN PATENT DOCUMENTS

| | | |
|---|---|---|
| WO | WO 00/55500 A | 9/2000 |

OTHER PUBLICATIONS

International Search Report and Written Opinion from PCT/US2008/076797, mailed on Feb. 25, 2009.

* cited by examiner

*Primary Examiner* — Erick Solis
(74) *Attorney, Agent, or Firm* — BainwoodHuang

(57) ABSTRACT

A crankshaft detection system includes a pickup element mounted to an end of a crankshaft and disposed within a rear portion of the aircraft engine's crankcase. The crankshaft detection system also includes pickup element sensor secured to a mounting location formed in the rear portion of the aircraft engine's crankcase and disposed in proximity to the pickup element. As the crankshaft rotates the pickup element relative to the pickup element sensor, the pickup element causes the pickup element sensor to generate a signal indicative of the angular velocity and rotational position of the crankshaft. In order to optimize engine performance, in response to the signal, the controller controls a spark event associated with each the cylinder assembly of the engine such that ignition of the fuel and air mixture occurs within each cylinder assembly at a time prior to each piston of each cylinder assembly reaching a top dead center position.

18 Claims, 7 Drawing Sheets

AIRCRAFT ENGINE CRANKSHAFT POSITION AND ANGULAR VELOCITY DETECTION APPARATUS

BACKGROUND

In conventional aircraft engines, engine controllers, such as full authority digital engine controllers (FADECs), control certain operating characteristics of the engines to enhance the engines' performance. For example, FADECs typically include a digital computer, known as an electronic engine control unit (ECU) and a variety of sensors that measure, for example, various environmental and engine conditions such as engine temperature, engine fluid pressures, air temperature, and air density. During operation of the engine, the ECU receives data signals from the sensors and calculates engine operating parameters based upon the data signals. Based upon the engine operating parameters, the FADEC controls certain engine components, such as the engine's fuel injection system and ignition timing, to adjust the engine's fuel usage and optimize the engine's performance.

For example, as each aircraft engine cylinder assembly receives a fuel and air mixture, a spark plug associated with each aircraft engine cylinder assembly ignites the fuel and air mixture. Under normal operating conditions, the spark plug initiates combustion of the fuel and air mixture when an associated crankshaft positions a piston of the cylinder assembly within about 15 to 40 degrees before a top dead center (TDC) position, the point of maximum compression of the fuel and air mixture. Ignition of the fuel and air mixture at a time prior to the piston reaching the TDC position maximizes the pressure required to displace the piston within a cylinder assembly housing to drive the crankshaft.

In order to cause or adjust the ignition of the fuel and air mixture at a time before the piston reaches a TDC position, the ECU must identify the rotational position or angle of the crankshaft along with the crankshaft's angular velocity. Accordingly, conventional aircraft engines utilize a detection system to detect the positioning and speed of the crankshaft. For example, in a conventional aircraft engine, the crankshaft includes a gear reduction assembly located at a rear portion of engine (i.e., the portion opposing the propeller) and a sensor positioned in proximity to the gear reduction assembly. The gear reduction assembly turns at a rate that is half of the angular velocity of the crankshaft. Accordingly, the sensor detects the half-rate rotation of the gear reduction assembly and provides an output signal, indicative of the crankshaft position and angular velocity, to the ECU. The ECU utilizes the output signal to approximate the position of each cylinder within each cylinder assembly and to adjust the spark timing for the cylinder.

SUMMARY

The use of conventional detection systems to detect the rotational position or and angular velocity of the crankshaft suffers from a variety of deficiencies. For example, when using a sensor to measure the half-rate rotation of the gear reduction assembly the output from the sensor is a relatively low-resolution output. Accordingly, the sensor provides the ECU with a relatively imprecise indication of the angular positioning and velocity of the crankshaft. This imprecision can compromise the ability for the ECU to detect the position of each cylinder within each cylinder assembly and to adjust the spark timing for the cylinder assembly accordingly. Furthermore, space limitations around the rear portion of conventional aircraft engines can limit the ability to position one or more sensors around the gear reduction assembly and thus inhibit the ability to obtain not only accurate but redundant readings of aircraft engine crankshaft position and angular velocity.

By contrast, embodiments of the present invention provide an aircraft engine crankshaft detection system. The crankshaft detection system includes a pickup element mounted to an end of a crankshaft and disposed within a rear portion of the aircraft engine's crankcase. The crankshaft detection system also includes pickup element sensor secured to a mounting location formed in the rear portion of the aircraft engine's crankcase and disposed in proximity to the pickup element. As the crankshaft rotates the pickup element relative to the pickup element sensor, the pickup element causes the pickup element sensor to generate a signal indicative of the angular velocity and rotational position of the crankshaft. A controller, such as a FADEC, receives the signal and detects a position of each piston in each cylinder assembly of the aircraft engine based upon the signal. In order to optimize engine performance, the controller controls a spark event associated with each the cylinder assembly of the engine such that ignition of the fuel and air mixture occurs within each cylinder assembly at a time prior to each piston of each cylinder assembly reaching a top dead center position.

In one arrangement, an aircraft engine assembly includes a crankcase assembly and a detection system. The crankcase assembly includes a crankcase housing and a crankshaft disposed within the crankcase housing. The crankshaft has a first end disposed in proximity to a propeller-mounting portion of the aircraft engine assembly and a second end disposed in proximity to a rear portion of the aircraft engine assembly where the second end opposes the first end. The detection system includes a pickup element mounted to the second end of the crankshaft, the pickup element operable to rotate at the angular velocity as the crankshaft. The detection system also includes a pickup element sensor disposed in proximity to the pickup element. The pickup element sensor is operable to generate a pickup element signal in response to rotation of the pickup element relative to the pickup element sensor. The pickup element signal indicates an angular velocity of the crankshaft and a rotational position of the crankshaft within the crankcase housing. A controller utilizes the pickup element signal to control spark timing of the cylinder assemblies of the aircraft engine.

In one arrangement, a crankshaft detection system for an aircraft engine includes a pickup element mounted to an end of a crankshaft and a pickup element sensor disposed in proximity to the pickup element. The end of the crankshaft is disposed in proximity to a rear portion of the aircraft engine and opposes a propeller-mounting portion of the aircraft engine. The pickup element is operable to rotate at the angular velocity as the crankshaft. The pickup element sensor is operable to generate a pickup element signal in response to rotation of the pickup element relative to the pickup element sensor. The pickup element signal indicates an angular velocity of the crankshaft and a rotational position of the crankshaft within a crankcase housing.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention provide an aircraft engine crankshaft detection system. The crankshaft detection system includes a pickup element mounted to an end of a crankshaft and disposed within a rear portion of the aircraft engine's crankcase. The crankshaft detection system also includes pickup element sensor secured to a mounting location formed in the rear portion of the aircraft engine's crankcase and disposed in proximity to the pickup element. As the crankshaft rotates the pickup element relative to the pickup element sensor, the pickup element causes the pickup element sensor to generate a signal indicative of the angular velocity and rotational position of the crankshaft. A controller, such as a FADEC, receives the signal and detects a position of each piston in each cylinder assembly of the aircraft engine based upon the signal. In order to optimize engine performance, the controller controls a spark event associated with each the cylinder assembly of the engine such that ignition of the fuel and air mixture occurs within each cylinder assembly at a time prior to each piston of each cylinder assembly reaching a top dead center position.

Figure 1:
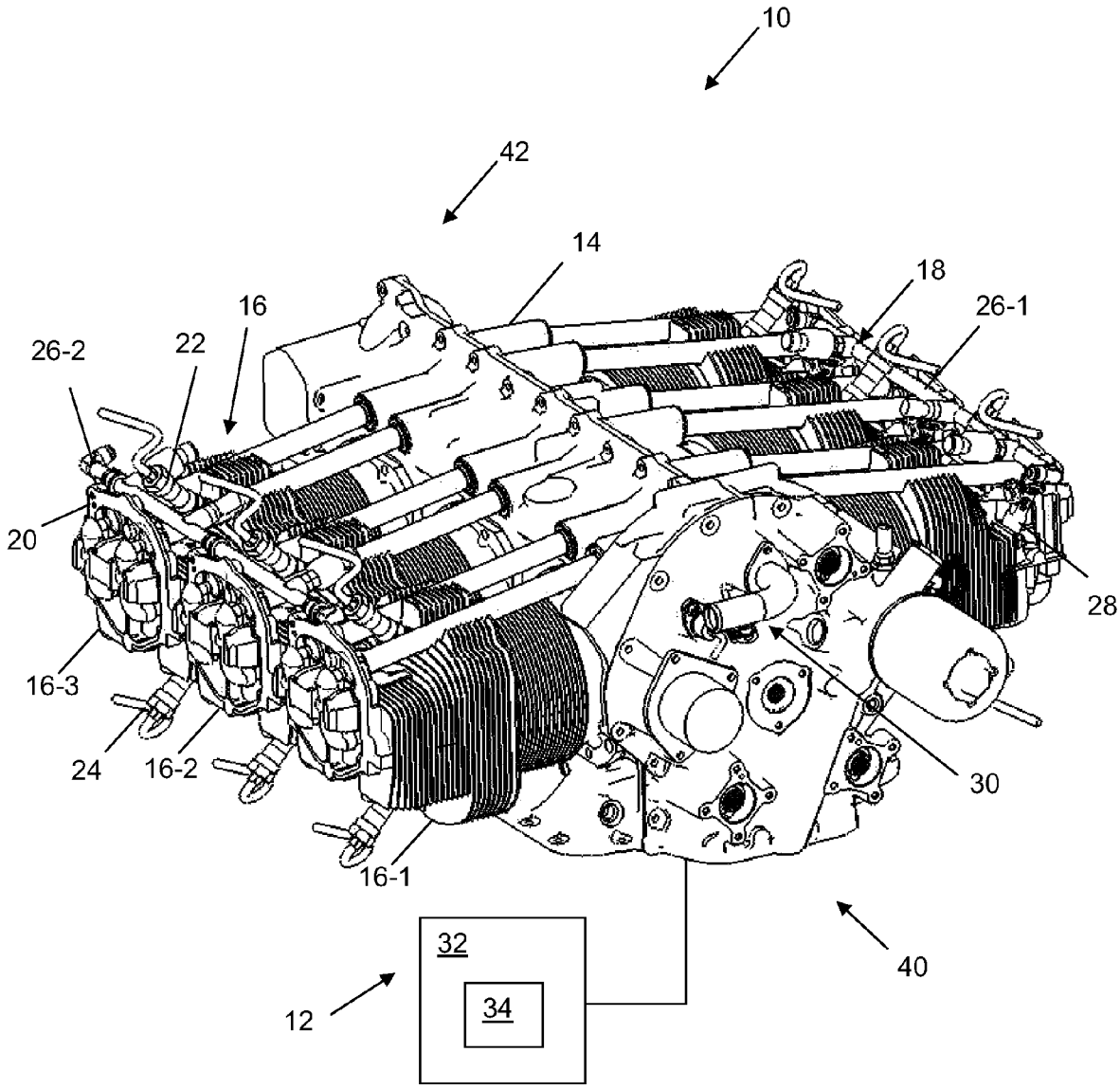
FIG. 1 illustrates a rear perspective view of an aircraft engine having a detection system utilized to detect the engine's crankshaft position and angular velocity, according to one embodiment of the invention.

FIG. 1 illustrates an aircraft engine 10 and an aircraft engine control system 12 according to one embodiment of the invention. The aircraft engine 10, such as a four-stroke engine, includes a crankcase housing 14 that contains a crankshaft (not shown) and that carries cylinder assemblies 16 and a fuel delivery system 18. Each cylinder assembly 16 includes a connecting rod (not shown) that connects the crankshaft to piston (not shown) disposed within the cylinder housings 20 of each cylinder assembly 16. Each cylinder assembly 16 also carries primary and secondary spark plugs 22, 24. The spark plugs 22, 24 are configured to ignite a fuel and air mixture contained within the cylinder assembly 16 during operation. The secondary spark plug 24 operates as a back-up to the primary spark plug 22 such that, in the event of failure of a primary spark plug 22 for a cylinder assembly 16, the secondary spark plug 24 provides ignition of the fuel and air mixture within the cylinder assembly 16.

The fuel delivery system 18 is configured to provide fuel from a fuel source to each of the cylinder assemblies 16. The fuel delivery system 18 includes a fuel pump (not shown), fuel rails 26-1, 26-2, and fuel injectors 28 configured to provide fuel from a fuel source to each of the cylinder assemblies 16. In use, each cylinder assembly 16 receives fuel via the fuel delivery system 18. The primary spark plug 22 ignites a fuel air mixture contained within each cylinder housing 20 thereby causing the piston and connecting rod disposed within each cylinder housing 20 to reciprocate therein. The reciprocating motion of the piston and connecting rod rotates the crankshaft which, in turn, rotates other components associated with the aircraft engine 10.

The aircraft engine control system 12 is configured to control the performance of the aircraft engine 10 during operation. While the engine controller 12 can be configured in a variety of ways, in one arrangement the engine controller 12 is configured as a Full Authority Digital Engine Controller (FADEC). The FADEC 32 includes a variety of sensors that measure various environmental and engine conditions such as engine temperature, engine fluid pressures, air temperature, and air density. The FADEC 32 also includes an electronic engine control unit (ECU) 34, such as a processor and a memory, which receives various data signals from the sensors and calculates engine operating parameters based upon the data signals. Based upon the engine operating parameters, the FADEC 32 optimizes the performance of the aircraft engine 10 by adjusting the aircraft engine's fuel metering system to control the flow of fuel to the cylinder assemblies 16, and optimizes spark timing.

While the aircraft engine 10 can include a variety of devices to measure various operating parameters associated with the aircraft engine 10 and to provide representative data signals to the engine controller 12, in one arrangement, the aircraft engine 10 also includes a crankshaft detection system 30, as illustrated in FIGS. 1-5, used to detect the positioning and angular velocity of the crankshaft 80 contained within the crankcase housing 14. Based upon the angular speed and position of the crankshaft 80, the aircraft engine control system 12 detects the position of each piston in each cylinder assembly 16. Accordingly, based upon each piston position within the cylinder assembly 16, the aircraft engine control system 12 adjusts the spark timing of each of the spark plugs 22 associated with each of the cylinder assemblies 16 to optimize engine performance. For example, the aircraft engine control system 12 can cause each spark plug 22 to ignite the fuel and air mixture contained within its corresponding cylinder assembly 16 when the piston of the cylinder assembly 16 arrives within about 15 to 40 degrees before a top dead center (TDC) position.

As indicated in FIG. 1, the detection system 30 is disposed at a rear portion 40 of the aircraft engine 10 where the rear portion 40 opposes a front portion or propeller-mounting portion 42 of the aircraft engine 10. Location of the piston-positioning detection system 30 at the rear portion 40 of the aircraft engine 10 minimizes the ability for the detection system 30 to be damaged during operation of the aircraft engine 10. For example, in certain cases, the alternator belt drive located at the front portion 42 of the aircraft engine 10 may generate debris during operation. By locating the detection system 30 at the rear portion 40 of the aircraft engine 10, in the case where the alternator belt drive generates debris, the debris is concentrated at the front portion 42 of the aircraft engine 10. Accordingly, damage to the detection system 30 is minimized in such a situation.

FIGS. 2-5 illustrate an arrangement of the crankshaft detection system 30. As illustrated, the crankshaft detection system 30 includes a crankshaft detection assembly 50 having a pickup element 54 and a pickup element sensor 56 disposed in electrical communication with the pickup element 54.

Figure 2:
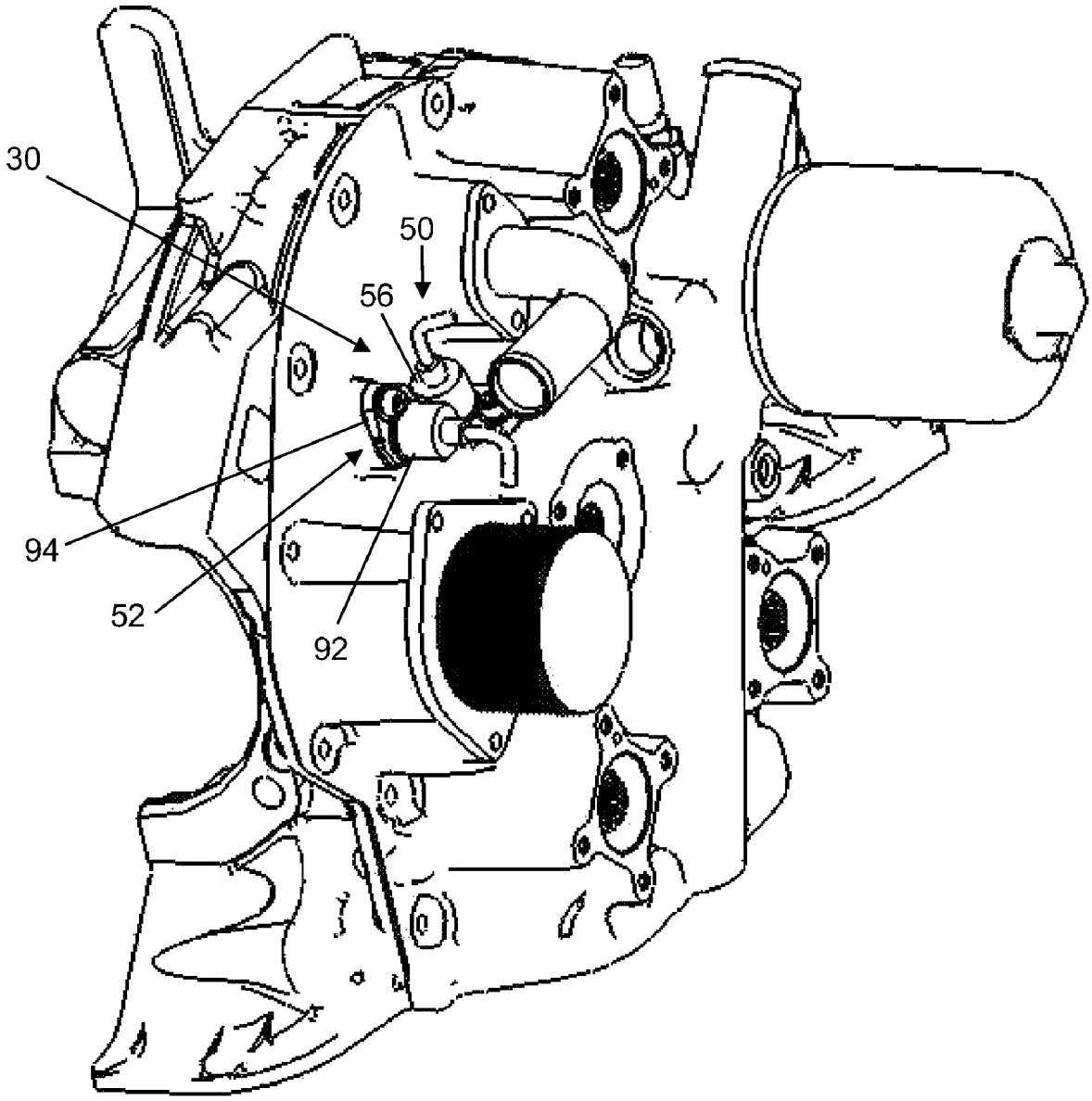
FIG. 2 illustrates sensors of the detection system of FIG. 1
Figure 3:
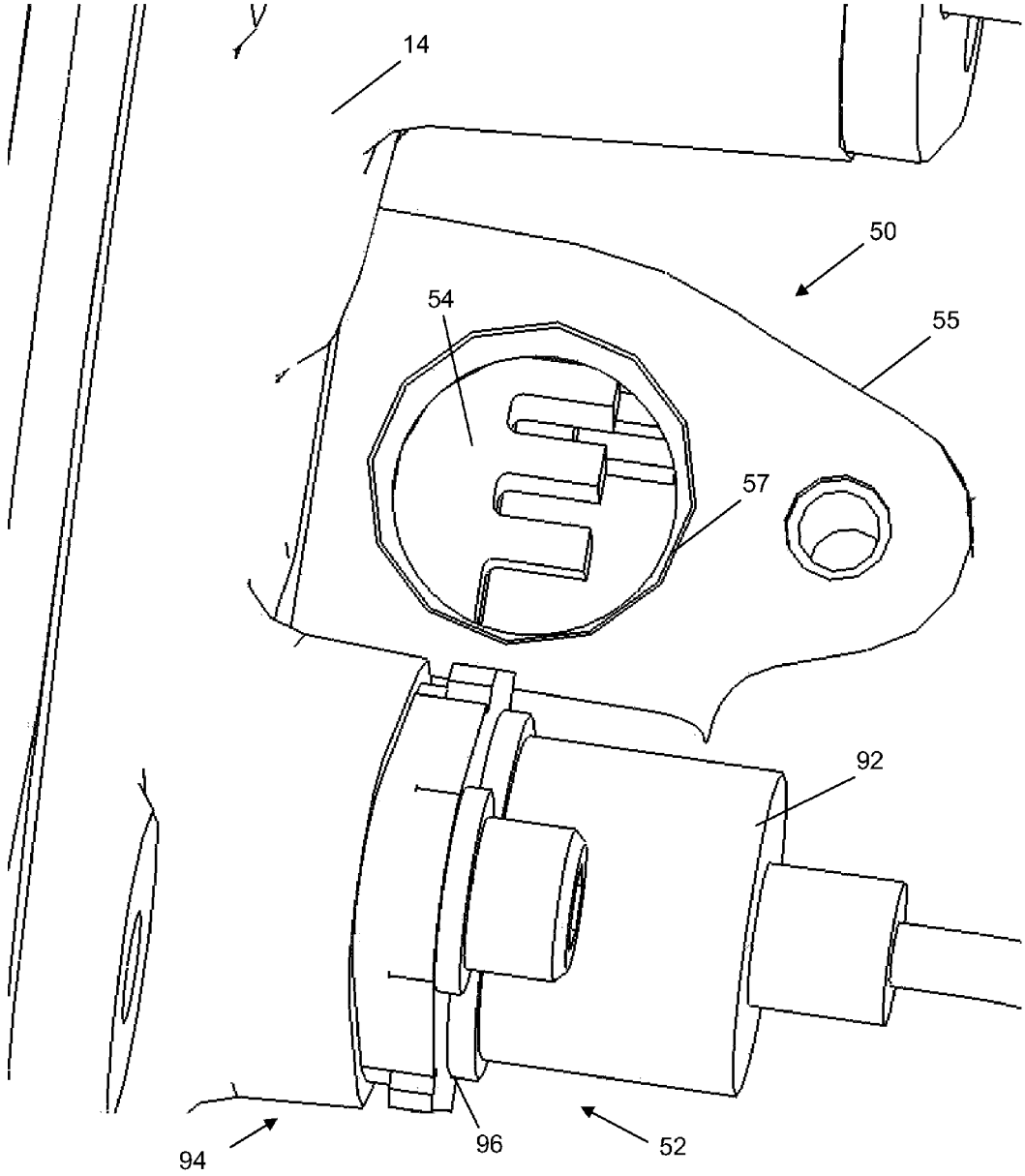
FIG. 3 illustrates an overhead view of the mounting location for a pickup element sensor of the detection system of FIG. 1.

The pickup element sensor 56 is configured to detect rotation of the pickup element 54, generate a pickup element signal in response to rotation of the pickup element 54, and to transmit the pickup element signal to the ECU 34. As indicated in FIGS. 1-3, the rear portion 40 of the aircraft engine 10 is configured to support the pickup element sensor 56. For example, with particular reference to FIG. 3, the crankcase housing 14 includes a sensor mounting location 55 defining an opening 57 positioned in proximity to the pickup element 54. The pickup element sensor 56 is at least partially disposed within the opening 57 and secured to the sensor mounting location 55. This configuration of the crankcase housing 14 provides adequate space for mounting of the pickup element sensor 56 to the rear portion 40 of the aircraft engine 10 and in proximity to the pickup element 54. As such, the sensor mounting location 55 provides the pickup element sensor 56 with the ability to obtain relatively accurate readings of the rotational position of the crankshaft 80.

A variety of types of sensors can be utilized as the pickup element sensor 56. In one arrangement, the pickup element sensor 56 is configured as a variable reluctance sensor having a magnetic pole and a wire coil wrapped about the pole. As will be described in detail below, the variable reluctance sensor operates in conjunction with the pickup element 54 to generate the pickup element signal for transmission to the ECU 34.

Figure 4A:
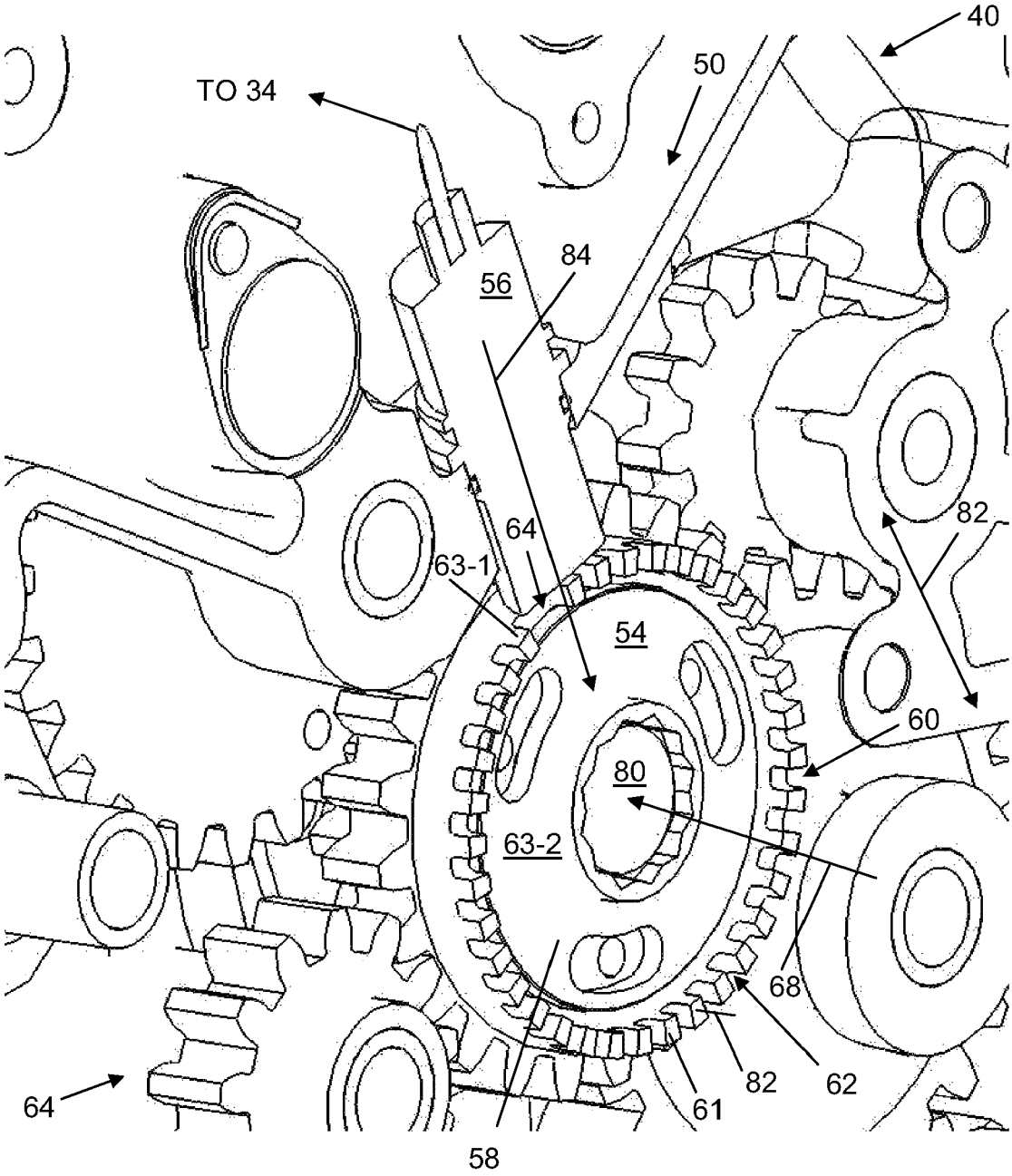
FIG. 4A illustrates a perspective view of a gear reduction assembly, a pickup element, and a pickup element sensor of the detection system of FIG. 1.

The crankshaft 80 extends along the length of the crankcase housing 14 from the front portion 42 of the engine 10 to the rear portion of the engine 10. With particular reference to FIG. 4A, the pickup element 54 is disposed on an end of a crankshaft 80, located at the rear portion 40 of the aircraft engine 10. As illustrated, the pickup element 54 includes a base 58 and a set of teeth 60 disposed on the base 58. The base 58 is carried by the crankshaft 80 such that as the crankshaft 80 rotates within the crankcase housing, the pickup element 54 rotates at the same angular velocity as the crankshaft 80. The teeth 60 are formed of a magnetic material and are configured to induce a signal in the pickup element sensor 56. In the arrangement illustrated in FIG. 4A, the teeth 60 do not mesh with the gears of the gear reduction assembly 64. As such, the pickup element 54 does not form part of the gear reduction assembly 64.

Figure 4B:
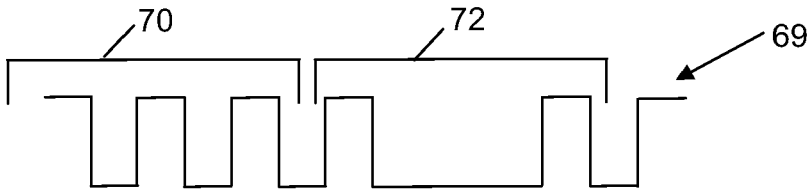
FIG. 4B illustrates a signal induced within the pickup element sensor of the detection system of FIG. 1.

As shown in FIG. 4A, the teeth 60 include a set of trigger teeth 61 and a pair of indicator teeth 63-1, 63-2 which are disposed about the outer periphery of the base 58. Adjacent trigger teeth 61 define set tooth spaces 62 disposed there between and the adjacent indicator teeth 63-1, 63-2 define a periodic indicator space 64 there between. As illustrated, the periodic indicator space 64 is larger than any of the set tooth spaces 62. The pickup element sensor 56 is configured to generate a pickup element signal 69 as illustrated in FIG. 4B in response to movement of the teeth 60, the set tooth spaces 62 and the periodic indicator space 64 past a face of the sensor 56. For example, as the pickup element 54 rotates along a longitudinal axis 68 of the crankshaft 80, in response to the rotation of the trigger teeth 61 and the set tooth spaces 62, the pickup element sensor 56 generates a series of relatively small pulses 70 and transmits the small pulses 70 to the ECU 34. In response to the rotation of the indicator teeth 63-1, 63-2 and the periodic indicator space 64, the pickup element sensor 56 generates a relatively large or elongated pulse 72 and transmits the elongated pulse 72 to the ECU 34.

As the ECU 34 receives the pickup element signal 69 from the pickup element sensor 56, the ECU 34 examines the pickup element signal 69 to detect the angular velocity and the rotational positioning of the crankshaft 80. For example, each small pulse 70 corresponds to a pass of one of the trigger teeth 61 past the pickup element sensor 56 and the elongated pulse 72 corresponds to a pass of the indicator teeth 63-1, 63-2 past the pickup element sensor 56. As a result, based on the number of small pulses 70 away from the last elongated pulse 72 the ECU 34 had received, the ECU 34 can detect the current rotational position of the crankshaft 80 within the crankcase 14. Additionally, based upon the number of elongated pulses 72 detected in a particular period of time, the ECU 34 can detect the angular velocity of the crankshaft 80.

The rotational position of the crankshaft 80 and the angular velocity of the crankshaft 80 provide to the ECU 34 an indication of a position of each piston in each cylinder assembly 16, relative to a TDC position. Accordingly, based on the pickup element signal 69, the ECU 34 controls a spark event associated with the cylinder assemblies 16 such that ignition of the fuel and air mixture within each cylinder assembly 16 occurs at a time prior to each respective piston reaching a TDC position, thereby optimizing engine performance.

While the pickup element 54 and the pickup element sensor 56 can be arranged in a variety of ways, in one arrangement the pickup element 54 and pickup element sensor 56 are oriented relative to each other to minimize measurement imprecision caused by lateral translation or wavering 82 of the end of the crankshaft 80. For example, as illustrated in FIG. 4A, the teeth 60 are disposed on the base 54 of the pickup element 54 such that a longitudinal axis 84 of each tooth is substantially parallel to the longitudinal axis 68 of the crankshaft 80. Additionally, the crankcase housing 14 carries the pickup element sensor 56 such that a longitudinal axis 84 of the pickup element sensor 56 is perpendicular to the longitudinal axis 68 of the crankshaft 80 and to the longitudinal axis 82 of each tooth 61, 63-1, 63-2. As the crankshaft 80 rotates about the longitudinal axis 68, in the case where the end of the crankshaft 80 translates along axis 82, the relative orientation of the longitudinal axis 84 of each tooth and the longitudinal axis 84 of the pickup sensor 56 maintains the teeth within the sensing path of the pickup sensor 56. Accordingly, such positioning minimizes measurement imprecision caused by lateral translation or wavering 82 of the end of the crankshaft 80 and allows the ECU 34 to receive a pickup element signal that provides an accurate representation of the angular velocity and rotational position of the crankshaft 80 within the crankcase 14.

As indicated above, the first detection assembly 50 provides a pickup element signal to the controller 12. Based upon the pickup element signal, the controller 12 detects the position of the pistons within the cylinder assembly housings. However, as indicated above, the engine 10 is a four-stroke engine. In a four-stroke engine, during operation, the piston approaches a TDC position twice during an operational cycle of the engine 10: once during a compression stroke when the piston compresses the fluid and air mixture within the cylinder assembly 16 and once during an exhaust stroke as the piston causes the gaseous byproduct of the combusted fuel and air mixture to be exhausted from the cylinder assembly 16. Accordingly, with the above described crankshaft detection assembly 50, the controller 12 controls a spark event associated the cylinder assemblies 16 such that the spark event occurs at a time prior to each respective piston reaching a TDC position, both during the compression stroke and during the exhaust stroke. However, the spark event occurring during the exhaust stroke is unnecessary.

During the operation of the engine 10, rotation of a camshaft controls the position of the intake and exhaust valves. Accordingly, the rotational position of the camshaft within the aircraft engine 10 indicates where each cylinder assembly is in the engine's firing process. For example, with reference to FIG. 1, based upon a rotational position of the camshaft within the crankcase housing 14, the camshaft can indicate that a spark event in the first cylinder assembly 16-1 has just occurred, a spark event in the second cylinder assembly 16-1 is occurring and that a spark event in the third cylinder assembly 16-3 is going to occur. In order to reduce unnecessary sparking during the exhaust stroke, in one arrangement the crankshaft detection system 30 includes a camshaft detection assembly 52 that detects the rotational position of the camshaft within the crankcase housing 14. As such, the camshaft detection assembly 52 provides a camshaft gear signal to the controller 12 indicative of the rotational position of the camshaft. In turn, the controller 12 utilizes the camshaft gear signal, in conjunction with the pickup element signal to control the spark events in the cylinder assemblies 16 during the compression strokes of their respective pistons.

With reference to FIG. 5, the camshaft detection assembly 52 includes a camshaft gear 90 disposed on a camshaft (not shown) and disposed in proximity to the end of the crankshaft 80. The camshaft detection assembly 52 also includes a camshaft gear sensor 92 disposed in proximity to the camshaft gear 90.

The camshaft gear sensor 92 is configured to detect rotation of the camshaft gear 90, generate a camshaft gear signal in response to rotation of the pickup element 54, and to transmit the camshaft gear signal to the ECU 34. As indicated in FIGS. 1-3, the rear portion 40 of the aircraft engine 10 is configured to support the camshaft gear sensor 92. For example, with particular reference to FIG. 3, the crankcase housing 14 includes a sensor mounting location 94 defining an opening 96 positioned in proximity to the camshaft gear 90. The camshaft gear sensor 92 is at least partially disposed within the opening 96 and secured to the sensor mounting location 94. This configuration of the crankcase housing 14 provides adequate space for mounting of the camshaft gear sensor 92 to the rear portion 40 of the aircraft engine 10 and in proximity to the camshaft gear 90. While a variety of types of sensors can be utilized as camshaft gear sensor 92, in one arrangement, the camshaft gear sensor 92 is configured as a variable reluctance sensor.

Figure 5A:
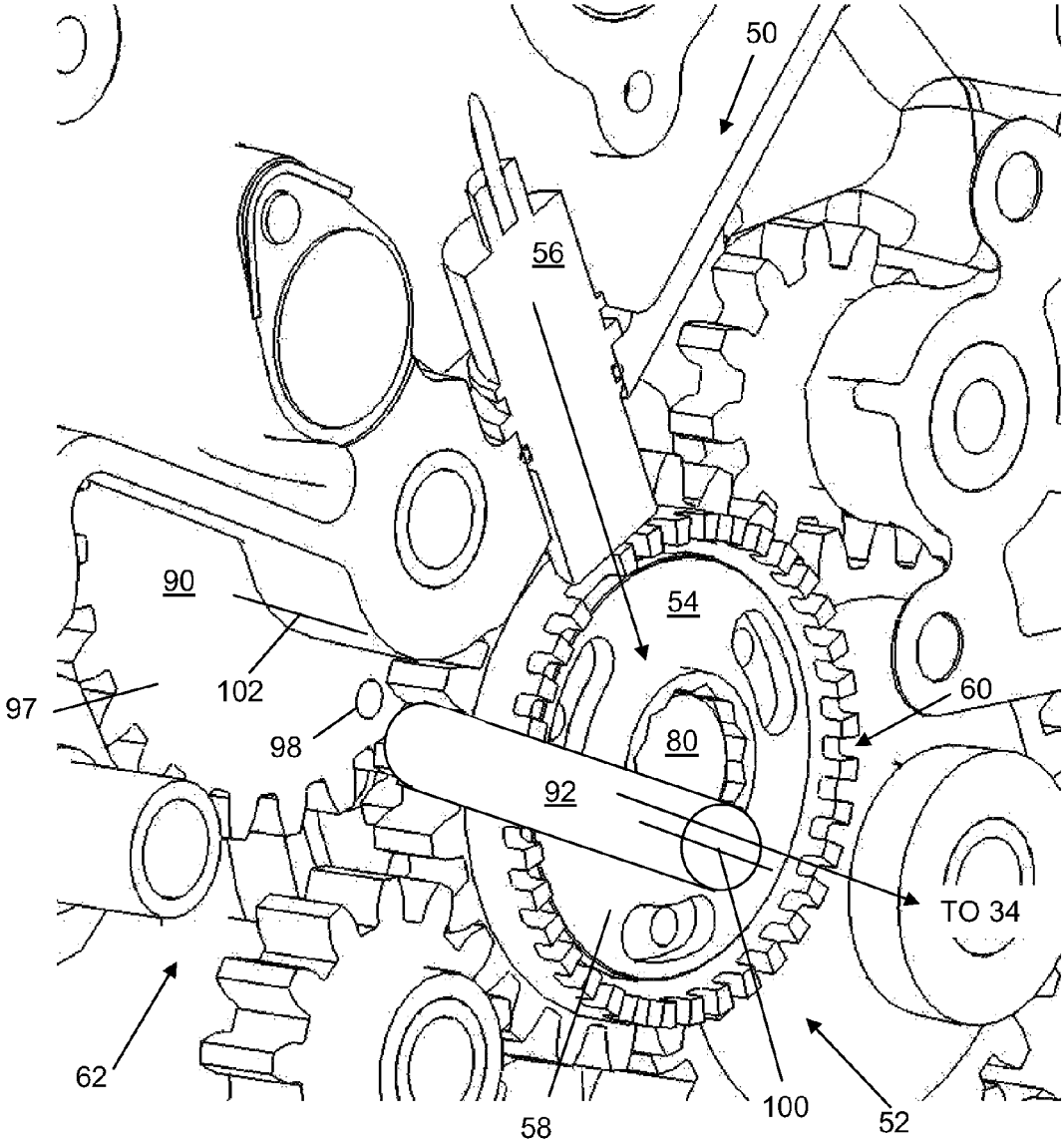
FIG. 5A illustrates a perspective view of a camshaft gear and a camshaft gear sensor of the detection system of FIG. 1.

With reference to FIG. 5A, the camshaft gear 90 includes a base 97 and a rotation indicator 98, such as an opening formed through the camshaft gear 90. The rotation indicator 98 rotates at one-half the speed of the crankshaft 80. With such a configuration, in order to detect rotation of the rotation indicator 98, the camshaft gear sensor 92 is disposed in proximity to the rotation indicator 98 of the camshaft gear 90 such that a longitudinal axis 100 of the camshaft gear sensor 92 is substantially parallel to a longitudinal axis 102. Accordingly, as the camshaft gear 90 rotates about axis 102, the camshaft gear 90 causes the camshaft gear sensor 92 to generate a camshaft gear signal indicative of the position of the camshaft and the corresponding pistons of the aircraft engine 10.

Figure 5B:
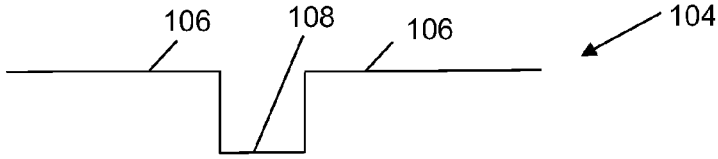
FIG. 5B illustrates a signal induced within a cam gear sensor of the detection system of FIG. 1.

As illustrated in FIG. 5B, the camshaft gear sensor 92 generates a camshaft gear signal 104 in response to rotation of the camshaft gear 90 past a face of the sensor 92. For example, as the camshaft gear 90 rotates along the longitudinal axis 102, the base 97 rotates past the camshaft gear sensor 92. In response to the rotation of the base 97, the camshaft gear sensor 92 generates an elongated pulse 106 and transmits the elongated pulse 106 to the ECU 34. As the rotation indicator 98 rotates past the camshaft gear sensor 92 the camshaft gear sensor 92 generates a trough pulse 108 and transmits the trough pulse 108 to the ECU 34. The ECU is configured such that the trough pulse 108 corresponds to particular state of in the engine's firing process (e.g., a spark event in the first cylinder assembly 16-1 has just occurred, a spark event in the second cylinder assembly 16-1 is occurring and that a spark event in the third cylinder assembly 16-3 is going to occur). Accordingly, as the ECU 34 utilizes the camshaft gear signal 104 in order to detect the TDC positioning the engine's pistons during a compression stroke. He ECU 34 utilizes the camshaft gear signal 104 in conjunction with the camshaft gear signal 104 to control a spark event each cylinder assembly as the piston for each cylinder assembly 16 reaches a TDC position during a compression stroke.

While various embodiments of the invention have been particularly shown and described, it will be understood by those skilled in the art that various changes in form and details may be made therein without departing from the spirit and scope of the invention as defined by the appended claims.

For example, as described above, in one arrangement, the crankshaft detection system 30 includes a camshaft detection assembly 52 that detects the rotational position of the camshaft within the crankcase housing 14. As such, the camshaft detection assembly 52 provides a camshaft gear signal to the controller 12 indicative of the rotational position of the camshaft. Such description is by way of example only. In one arrangement, with reference to FIGS. 6 and 7, the camshaft detection assembly 52 is configured to provide a camshaft gear signal to the controller 12 indicative of both the angular velocity of the crankshaft 80 and a rotational position of a camshaft 150.

Figure 6:
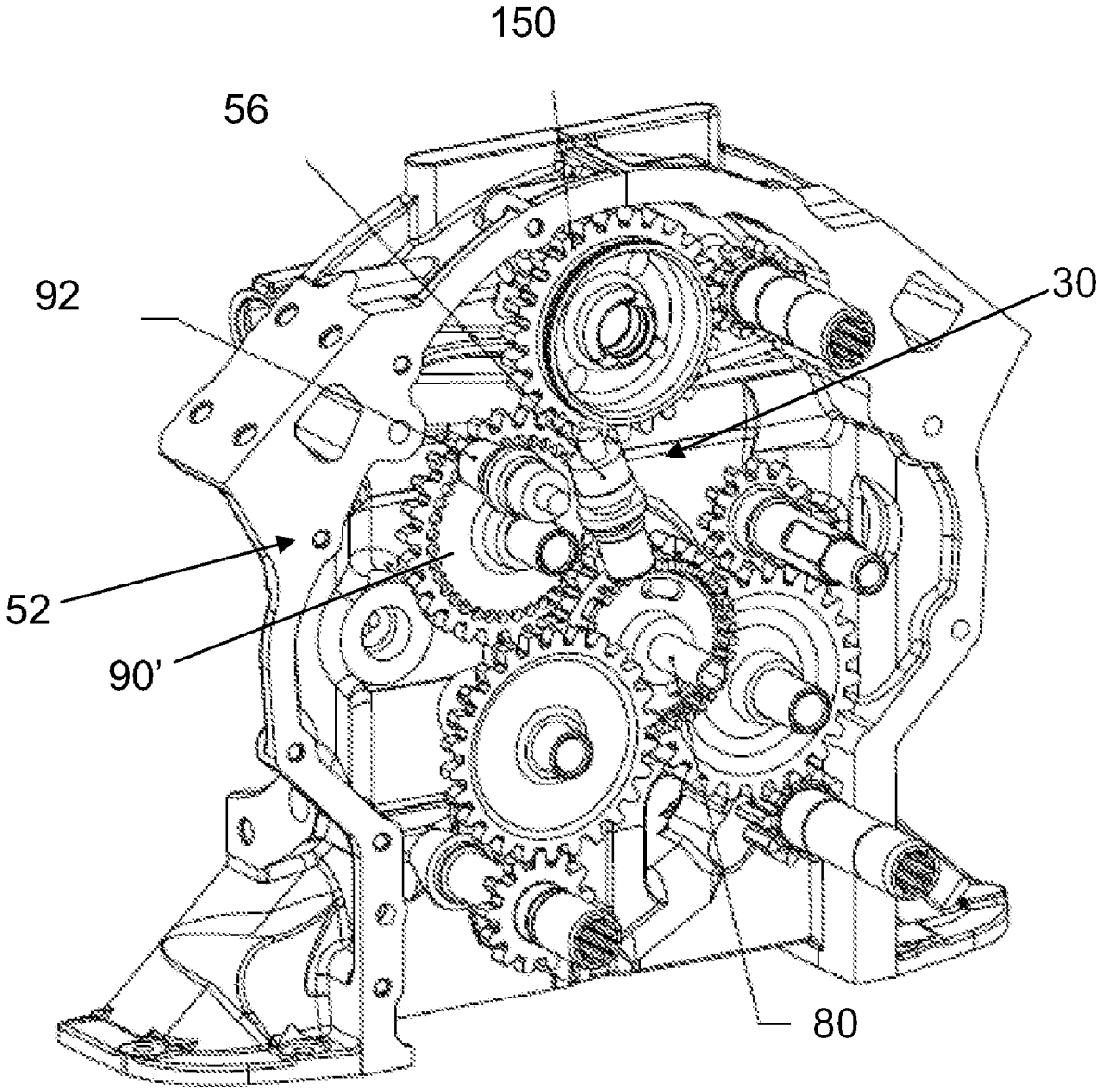
FIG. 6 illustrates an alternate embodiment of a camshaft gear of FIG. 5A.
Figure 7:
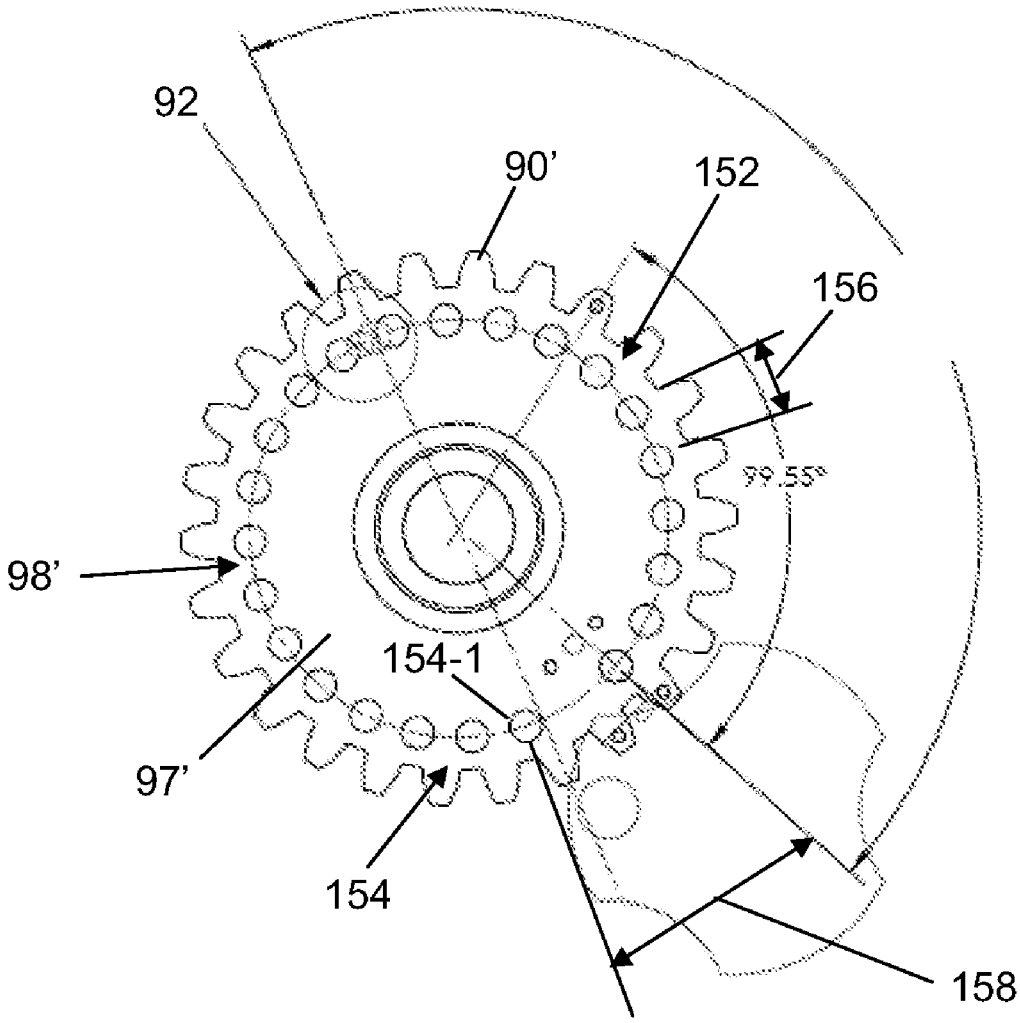
FIG. 7 illustrates the camshaft gear of FIG. 6.
Figure 8:
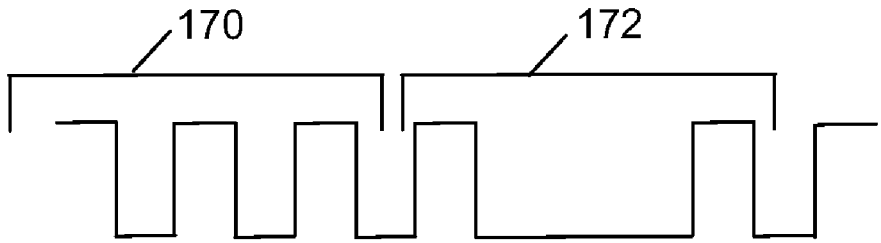

For example, the camshaft gear 90' includes a base 97' and rotation indicators 98', such as a series of openings formed through the camshaft gear 90'. As shown in FIG. 6, the rotation indicators 98' include a set of trigger openings 152 and a pair of indicator openings 154-1, 154-2 which are disposed about the outer periphery of the base 97'. Adjacent trigger openings 152 define set spaces 156 disposed there between and the adjacent indicator openings 154-1, 154-2 define a periodic indicator space 158 there between. As illustrated, the periodic indicator space 158 is larger than any of the set spaces 156. The camshaft gear sensor 92 is configured to generate a camshaft gear signal 160, as illustrated in FIG. 8, in response to movement of the camshaft gear 90' past a face of the camshaft gear sensor 92. For example, as the camshaft gear 90' rotates, in response to the rotation of the set of trigger openings 152, the camshaft gear sensor 92 generates a series of relatively small pulses 170 and transmits the small pulses 170 to the ECU 34. In response to the rotation of the indicator openings 154-1, 154-2, the camshaft gear sensor 92 generates a relatively large or elongated pulse 172 and transmits the elongated pulse 172 to the ECU 34.

As the ECU 34 receives the camshaft gear signal 160 from the camshaft gear sensor 92, the ECU 34 examines the camshaft gear signal 160 to detect the angular velocity of the crankshaft 80 and the rotational positioning of the camshaft 150. For example, each small pulse 170 corresponds to a pass of one of the trigger openings 152 past the camshaft gear sensor 92 and the elongated pulse 172 corresponds to a pass of the indicator openings 154-1, 154-2 past the camshaft gear sensor 92. As a result, based on the number of small pulses 170 away from the last elongated pulse 172 the ECU 34 had received, the ECU 34 can detect the current rotational position of the camshaft 150, indicative of relative positions of the pistons within their respective cylinder assemblies. Additionally, based upon the number of elongated pulses 172 detected in a particular period of time, the ECU 34 can detect the angular velocity of the crankshaft 80. The camshaft gear 90' and camshaft gear sensor 92, therefore, provide information about the angular velocity of the crankshaft 80 and the rotational positioning of the camshaft 150 independent from the information provided by the pickup element 54 and the pickup element sensor 56. Accordingly, in this arrangement, the camshaft gear 90' and camshaft gear sensor 92 can operate either independently from, or as a redundant back-up to, the pickup element 54 and a pickup element sensor 56.

What is claimed is:

1. An aircraft engine assembly, comprising:

a crankcase assembly having a crankcase housing and a crankshaft disposed within the crankcase housing, the crankshaft having a first end disposed in proximity to a propeller-mounting portion of the aircraft engine assembly and a second end disposed in proximity to a rear portion of the aircraft engine assembly, the second end opposing the first end; and a detection system having:

a pickup element mounted to the second end of the crankshaft, the pickup element operable to rotate at the angular velocity of the crankshaft, wherein the pickup element comprises:

a base supported by the crankshaft; and a plurality of teeth disposed on the base, each tooth of the plurality of teeth having a longitudinal axis extending from the base substantially parallel to a longitudinal axis of the crankshaft, and a pickup element sensor disposed in proximity to the pickup element, the pickup element sensor being operable to generate a pickup element signal in response to rotation of the pickup element relative to the pickup element sensor, the pickup element signal indicating an angular velocity of the crankshaft and a rotational position of the crankshaft within the crankcase housing, wherein the pickup element sensor defines a longitudinal axis, the pickup element sensor being disposed relative to the plurality of teeth of the pickup element such that the longitudinal axis of the pickup element sensor is substantially perpendicular to the longitudinal axis of each tooth of the plurality of teeth.

2. The aircraft engine assembly of claim 1, wherein the plurality of teeth comprise a set of trigger teeth and a pair of indicator teeth disposed about an outer periphery of the base, adjacent trigger teeth defines set tooth spaces disposed there between and the adjacent indicator teeth define a periodic indicator space there between, the periodic indicator space being larger than any of the set tooth spaces;

wherein, in response to the rotation of the trigger teeth and the set tooth spaces past the pickup element sensor, the pickup element sensor generates a series of pulses having a first size and in response to the rotation of the indicator teeth and the periodic indicator space past the pickup element sensor, the pickup element sensor generates a pulse having a second size larger than the first size.

3. The aircraft engine of claim 1, wherein the crankcase housing defines an opening positioned in proximity to the pickup element and defining a longitudinal axis substantially perpendicular to the longitudinal axis of the crankshaft, the pickup element sensor being disposed within the opening and coupled to the crankcase housing such that the longitudinal axis of the pickup element sensor is substantially parallel to the longitudinal axis of the opening.

4. The aircraft engine assembly of claim 1, comprising:

a controller disposed in electrical communication with the pickup element sensor, the controller configured to:

receive the pickup element signal generated by the pickup element sensor;

detect an angular velocity of the crankshaft and a rotational position of the crankshaft within the crankcase housing; and control a spark event associated with at least one cylinder assembly based upon the angular velocity of the crankshaft and the rotational position of the crankshaft within the crankcase housing.

5. The aircraft engine assembly of claim 1, wherein the detection system further comprises:

a camshaft gear disposed on a camshaft and disposed in proximity to the second end of the crankshaft; and a camshaft gear sensor disposed in proximity to the camshaft gear, the camshaft gear sensor being operable to generate a camshaft gear signal in response to rotation of the camshaft gear relative to the camshaft gear sensor, the camshaft gear signal indicating an angular velocity of the crankshaft and a rotational position of the crankshaft within the crankcase housing, the rotational position of the crankshaft within the crankcase housing indicating a top dead center position of at least one piston within a cylinder assembly of the aircraft engine assembly.

6. The aircraft engine assembly of claim 5, wherein the camshaft gear sensor defines a longitudinal axis, the camshaft gear sensor being disposed relative to a rotation indicator of the camshaft gear such that the longitudinal axis of the camshaft gear sensor is substantially parallel to a longitudinal axis of the camshaft gear.

7. The aircraft engine of claim 6, wherein the crankcase housing defines an opening positioned in proximity to the camshaft gear and defining a longitudinal axis substantially parallel to the longitudinal axis of the camshaft gear, the camshaft gear sensor being disposed within the opening and coupled to the crankcase housing such that the longitudinal axis of the camshaft gear sensor is substantially parallel to the longitudinal axis of the opening.

8. The aircraft engine assembly of claim 5, comprising:

a controller disposed in electrical communication with the pickup element sensor and with the camshaft gear sensor, the controller configured to:

receive the pickup element signal generated by the pickup element sensor and the camshaft gear signal generated by the camshaft gear sensor;

detect an angular velocity of the crankshaft and a rotational position of the crankshaft within the crankcase housing based upon the pickup element signal detect a top dead center positioning of at least one piston during a compression stroke based upon the pickup element signal and the camshaft gear signal; and control a spark event of associated with a cylinder assembly carrying the at least one piston based upon the angular velocity of the crankshaft and the top dead center positioning of the at least one piston.

9. A crankshaft detection system for an aircraft engine, comprising:

a pickup element mounted to an end of a crankshaft, the end of the crankshaft disposed in proximity to a rear portion of the aircraft engine and opposing a propeller-mounting portion of the aircraft engine, the pickup element operable to rotate at the angular velocity as the crankshaft, wherein the pickup element comprises:

a base supported by the crankshaft; and a plurality of teeth disposed on the base, each tooth of the plurality of teeth having a longitudinal axis extending from the base substantially parallel to a longitudinal axis of the crankshaft, and a pickup element sensor disposed in proximity to the pickup element, the pickup element sensor being operable to generate a pickup element signal in response to rotation of the pickup element relative to the pickup element sensor, the pickup element signal indicating an angular velocity of the crankshaft and a rotational position of the crankshaft within a crankcase housing, wherein the pickup element sensor defines a longitudinal axis, the pickup element sensor being disposed relative to the plurality of teeth of the pickup element such that the longitudinal axis of the pickup element sensor is substantially perpendicular to the longitudinal axis of each tooth of the plurality of teeth.

10. The crankshaft detection system of claim 9, wherein the plurality of teeth comprise a set of trigger teeth and a pair of indicator teeth disposed about an outer periphery of the base, adjacent trigger teeth defines set tooth spaces disposed there between and the adjacent indicator teeth define a periodic indicator space there between, the periodic indicator space being larger than any of the set tooth spaces;

wherein, in response to the rotation of the trigger teeth and the set tooth spaces past the pickup element sensor, the pickup element sensor generates a series of pulses having a first size and in response to the rotation of the indicator teeth and the periodic indicator space past the pickup element sensor, the pickup element sensor generates a pulse having a second size larger than the first size.

11. The crankshaft detection system of claim 9, comprising:

a controller disposed in electrical communication with the pickup element sensor, the controller configured to:

receive the pickup element signal generated by the pickup element sensor;

detect an angular velocity of the crankshaft and a rotational position of the crankshaft within the crankcase housing; and control a spark event associated with at least one cylinder assembly based upon the angular velocity of the crankshaft and the rotational position of the crankshaft within the crankcase housing.

12. The crankshaft detection system of claim 9, further comprising:

a camshaft gear disposed on a camshaft and disposed in proximity to the second end of the crankshaft; and a camshaft gear sensor disposed in proximity to the camshaft gear, the camshaft gear sensor being operable to generate a camshaft gear signal in response to rotation of the camshaft gear relative to the camshaft gear sensor, the camshaft gear signal indicating an angular velocity of the crankshaft and a rotational position of the crankshaft within the crankcase housing, the rotational position of the crankshaft within the crankcase housing indicating a top dead center position of at least one piston within a cylinder assembly of the aircraft engine assembly.

13. The crankshaft detection system of claim 12, wherein the camshaft gear sensor defines a longitudinal axis, the camshaft gear sensor being disposed relative to a rotation indicator of the camshaft gear such that the longitudinal axis of the camshaft gear sensor is substantially parallel to a longitudinal axis of the camshaft gear.

14. The crankshaft detection system of claim 12, comprising:

a controller disposed in electrical communication with the pickup element sensor and with the camshaft gear sensor, the controller configured to:

receive the pickup element signal generated by the pickup element sensor and the camshaft gear signal generated by the camshaft gear sensor;

detect an angular velocity of the crankshaft and a rotational position of the crankshaft within the crankcase housing based upon the pickup element signal detect a top dead center positioning of at least one piston during a compression stroke based upon the pickup element signal and the camshaft gear signal; and control a spark event associated with a cylinder assembly carrying the at least one piston based upon the angular velocity of the crankshaft and the top dead center positioning of the at least one piston.

15. An aircraft engine assembly, comprising:

a crankcase assembly having a crankcase housing and a crankshaft disposed within the crankcase housing, the crankshaft having a first end disposed in proximity to a propeller-mounting portion of the aircraft engine assembly and a second end disposed in proximity to a rear portion of the aircraft engine assembly, the second end opposing the first end; and a detection system having:

a camshaft gear disposed on a camshaft and disposed in proximity to the second end of the crankshaft, and a camshaft gear sensor disposed in proximity to the camshaft gear, the camshaft gear sensor being operable to generate a camshaft gear signal in response to rotation of the camshaft gear relative to the camshaft gear sensor, the camshaft gear signal indicating an angular velocity of the crankshaft and a rotational position of the crankshaft within the crankcase housing, the rotational position of the crankshaft within the crankcase housing indicating a top dead center position of at least one piston within a cylinder assembly of the aircraft engine assembly, wherein the camshaft gear defines set of trigger openings and a pair of indicator openings disposed about an outer periphery of the camshaft gear, adjacent trigger openings defining set opening spaces disposed there between and the adjacent indicator openings defining a periodic indicator space there between, the periodic indicator space being larger than any of the set opening spaces.

16. The aircraft engine assembly of claim 15, wherein:

the set of trigger openings extends through the camshaft gear; and the pair of indicator openings extend through the camshaft gear.

17. The aircraft engine assembly of claim 5, wherein, the camshaft gear defines set of trigger openings and a pair of indicator openings disposed about an outer periphery of the camshaft gear, adjacent trigger openings defining set opening spaces disposed there between and the adjacent indicator openings defining a periodic indicator space there between, the periodic indicator space being larger than any of the set opening spaces;

the set of trigger openings extends through the camshaft gear; and the pair of indicator openings extend through the camshaft gear.

18. The crankshaft detection system of claim 12, wherein:

the camshaft gear defines set of trigger openings and a pair of indicator openings disposed about an outer periphery of the camshaft gear, adjacent trigger openings defining set opening spaces disposed there between and the adjacent indicator openings defining a periodic indicator space there between, the periodic indicator space being larger than any of the set opening spaces;

the set of trigger openings extends through the camshaft gear; and the pair of indicator openings extend through the camshaft gear.

* * * * *